US006095229A

United States Patent [19]

Kellogg et al.

[11] Patent Number: 6,095,229

[45] **Date of Patent: *Aug. 1, 2000**

[54] OVERHEAD DOOR AND TRACK THEREFOR

[75] Inventors: Kurt A. Kellogg, Delafield, Wis.; Michael I. Tich, Baltimore, Md.; William A. Schirado, Plymouth; Gregory D. Yarke, Anoka, both of Minn.

[73] Assignee: United Dominion Industries, Inc., Charlotte, N.C.

[ * ] Notice: This patent is subject to a terminal disclaimer.

[21] Appl. No.: 09/432,912

[22] Filed: Nov. 2, 1999

Related U.S. Application Data

[63] Continuation of application No. 09/008,346, Jan. 16, 1998, Pat. No. 6,041,844, and a continuation of application No. 08/680,436, Jul. 15, 1996, abandoned, and a continuation of application No. 08/198,832, Feb. 18, 1994, Pat. No. 5,535,805.

[51] Int. Cl.[7] ..... E05D 15/16

[52] U.S. Cl. ..... 160/201; 160/281; 16/87 R

[58] Field of Search ..... 160/201, 264, 160/310, 133, 280–289, 276; 16/87 R, 102, 89, 90, 93 R, 96 R; 49/197; 292/DIG. 36

[56] References Cited

U.S. PATENT DOCUMENTS

| | | | |
|---|---|---|---|
| D. 245,266 | 8/1977 | Gorse . | |
| 1,786,054 | 12/1930 | Dixson . | |
| 1,787,451 | 1/1931 | Mohun et al. . | |
| 2,094,932 | 10/1937 | Swan . | |
| 2,187,242 | 1/1940 | Kesner | 160/288 |
| 4,452,293 | 6/1984 | Gorse . | |
| 4,478,268 | 10/1984 | Palmer . | |
| 4,676,293 | 6/1987 | Hanssen . | |
| 4,690,195 | 9/1987 | Taylor . | |
| 4,880,045 | 11/1989 | Stahler . | |
| 5,025,847 | 6/1991 | Mueller . | |
| 5,056,579 | 10/1991 | Krafutler . | |
| 5,139,075 | 8/1992 | Desrouchers . | |
| 5,141,043 | 8/1992 | Kraeutler . | |
| 5,141,044 | 8/1992 | Hying et al. . | |
| 5,163,494 | 11/1992 | MacNeil et al. . | |
| 5,219,015 | 6/1993 | Kraeutler . | |
| 5,222,541 | 6/1993 | Hornberger . | |
| 5,535,805 | 7/1996 | Kellogg et al. . | |

FOREIGN PATENT DOCUMENTS

| | | |
|---|---|---|
| 247856 | 12/1960 | Australia . |

*Primary Examiner*—Blair M. Johnson
*Attorney, Agent, or Firm*—Adams Law Firm, P.A.

[57] ABSTRACT

An overhead door for occluding an opening in a structure. The door includes a pair of tracks having inwardly facing surfaces which define a channel. A door panel is located intermediate the pair of tracks and moveable along a predetermined path of travel which is defined by the tracks. A release assembly is borne by the door panel and is operable to releasably engage at least one of the tracks. The release assembly includes a moveable plunger which is received in the channel of one of the tracks and which guides the door panel along the path of travel. The plunger disengages from the channel when force of a predetermined magnitude is applied to the door panel.

6 Claims, 5 Drawing Sheets

OVERHEAD DOOR AND TRACK THEREFOR

CROSS-REFERENCE TO RELATED APPLICATIONS

This application is a continuation application of U.S. Ser. No. 09/008,346, filed Jan. 16, 1998 now U.S. Pat. No. 6,041,844, U.S. Ser. No. 08/680,436, filed Jul. 15, 1996 now abandoned and U.S. Ser. No. 08/198,832, filed Feb. 18, 1994 (now U.S. Pat. No. 5,535,805).

BACKGROUND OF THE INVENTION

The present invention relates to overhead doors. More specifically, the present invention relates to an overhead door that is guided along a predetermined path of travel by a pair of tracks and is operable to disengage from the tracks when exposed to force of a predetermined magnitude, thereby preventing damage to the door, tracks, and surrounding structure.

Overhead doors have long been used to occlude openings in structures such as warehouses, factories, and the like. In addition, impact-resistant overhead doors such as those illustrated in U.S. Pat. No. 4,676,293, issued to Hanssen, and U.S. Pat. No. 5,025,847, issued to Mueller, have been developed to absorb or otherwise reduce the destructive force of impacts to an overhead door, thereby preventing damage to the door and surrounding structure.

While these and other known doors have operated with some degree of success, they have several shortcomings. Specifically, the impact-resistant doors which are shown in U.S. Pat. No. 5,025,847, are unduly cumbersome and complex. Complex door designs, of course, greatly increase the cost of manufacturing and maintaining such doors. Further, known release assemblies used in doors, while finding usefulness with specific types of overhead doors, such as industrial roll-up doors, have not been rendered useful for all types of doors including doors manufactured from rigid, panels.

Known devices suffer from additional problems. They often fail to release under some conditions, thereby causing damage to the door or surrounding structure, or in the alternative, a workman must spend time with various tools to reset, or otherwise readjust the door following impact. Many doors release in a specific direction only. Consequently, significant damage to the door will result if force is applied from the opposite direction.

Therefore, it would be desirable to have an overhead door that reliably moves along a predetermined path of travel to selectively occlude an opening in a structure and that releases from an associated track when exposed to force of a predetermined magnitude, thereby substantially preventing damage to the overhead door, track, and surrounding structure.

SUMMARY OF THE INVENTION

Therefore, it is an object of the present invention to provide an improved overhead door and tracks therefor.

Another object of the present invention is to provide an overhead door that is readily adaptable to nearly all common, building designs.

Another object of the present invention is to provide an overhead door that reliably releases from its tracks when exposed to force of a predetermined magnitude without damaging the associated track or surrounding structure.

Another object of the present invention is to provide an overhead door that is operable, in one form, to release when force is applied to either side of the door.

Another object of the present invention is to provide an overhead door that can be quickly and easily placed back into operation following disengagement from the associated track.

Still another object of the present invention is to provide an overhead door assembly which has an articulated, rigid panel construction and where the articulated, rigid panels have a light-weight construction in comparison to prior-art assemblies having substantially similar designs.

These and other objects and advantages are achieved in an overhead door that includes a pair of tracks which are mounted on an associated structure. Each of the tracks has an inwardly facing surface which defines a channel. A door panel is located intermediate the pair of tracks and is movable along a predetermined path of travel which is defined by the tracks. A release assembly borne by the door panel is operable to releasably engage at least one of the tracks and includes a moveable plunger which is received in the channel of one of the tracks and which facilitates the movement of the door panel along the path of travel and further disengages from the channel when force of a predetermined magnitude is applied to the door panel, thereby preventing the door panel and tracks from being damaged.

DETAILED DESCRIPTION

Figure 1:
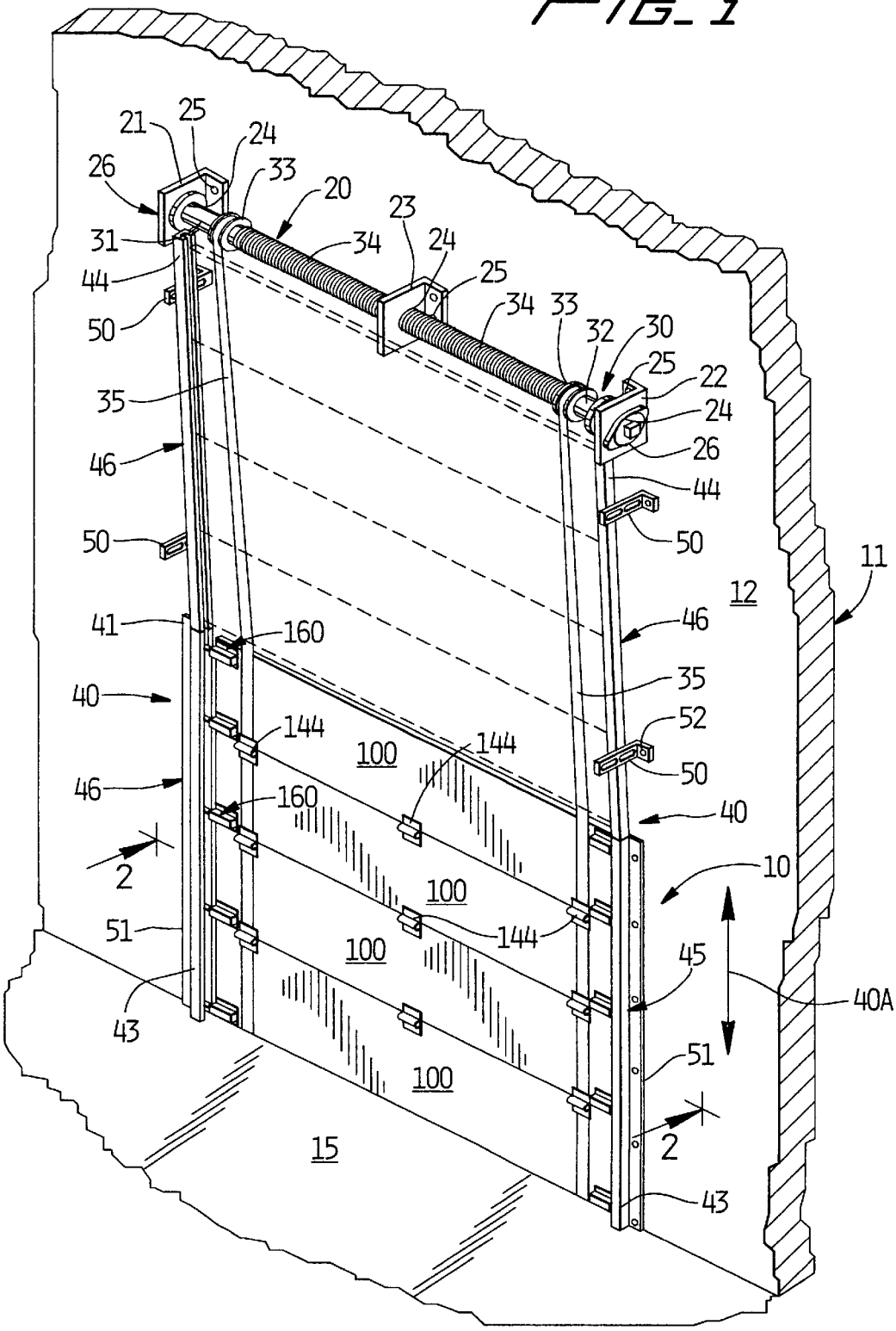
FIG. 1 is a perspective, environmental view of an overhead door of the present invention and is shown in a typical operative environment.

An overhead door 10 of the present invention is shown in FIG. 1. The overhead door 10 may be installed, for example, on a building 11. The building 11 has a wall or bulkhead 12 with a peripheral edge 13 which defines an opening 14. The building also has a floor 15.

A spring or retraction assembly 20 of conventional design is mounted in a position in predetermined, spaced relationship above the opening 14. The spring assembly 20 includes first, second, and third supports brackets 21, 22, and 23, respectively, mounted in predetermined spaced relation one to the other. Apertures 24, of predetermined dimensions, are formed in each of the support brackets. The apertures 24 are oriented in substantially coaxially alignment, one to the other. Fasteners 25 of conventional design are operable to secure the individual support brackets in their predetermined orientation relative to the wall or bulkhead 12. Two bearing assemblies 26 are mounted on the first and second support brackets. The bearing assemblies are positioned in substantially coaxially registry with the individual apertures 24 which are defined by same.

An axle assembly 30 is rotatably received in the respective apertures 24. The axle assembly 30 has a first end 31 and an opposite second end 32. The opposite ends are individually rotatably supported in the respective bearing assemblies 26. Two take-up pulleys 33 are secured by conventional fastening means in predetermined fixed positions in spaced relationship relative to the first and second ends 31 and 32, respectively. Further, two coil springs 34 are each fastened on the third support bracket 23 and are received about, and fastened on, the axle 32. The coil springs are operable to exert a biasing force on the axle causing it to rotate in a predetermined direction. Typically, the biasing force of the springs greatly reduces the force necessary to lift or move the overhead door 10 into an open position as shown in phantom lines in FIG. 1, and permits the overhead door to be positioned at desired locations thereby selectively occluding the opening 14. Two cables 35 are fastened on the individual take-up pulleys and are operable to transmit force from the axle assembly to the overhead door assembly.

The overhead door 10 acts in combination with a pair of tracks 40 fastened on the wall 12. The tracks 40 define a path of travel 40A for the overhead door 10. While the path of travel 40A is shown as a substantially linear path, the overhead door may follow a curved path of travel into a position which is substantially parallel to the floor 15. This type of installation would typically be utilized in residential applications.

The tracks are disposed in predetermined, substantially parallel spaced relation one to the other. The pair of tracks include a first track 41, and a second track 42. Each of the tracks has a first end 43, which rests on, or near the floor 15, and a second end 44, which is remote thereto. The first and second tracks each have an upper portion 45 and a lower portion 46 which are positioned in end-to-end relation and are disposed in mating registry one with the other. The upper portion 45 of each of the tracks is supported in predetermined spaced relation relative to the wall 12 by a support bracket 50. Support brackets 51 support the lower portion of individual tracks 40 in a fixed position which is substantially parallel to the surface of the wall. Individual fasteners 52 attach the respective support brackets 50 and 51 to the surface of the wall 12.

Figure 3:
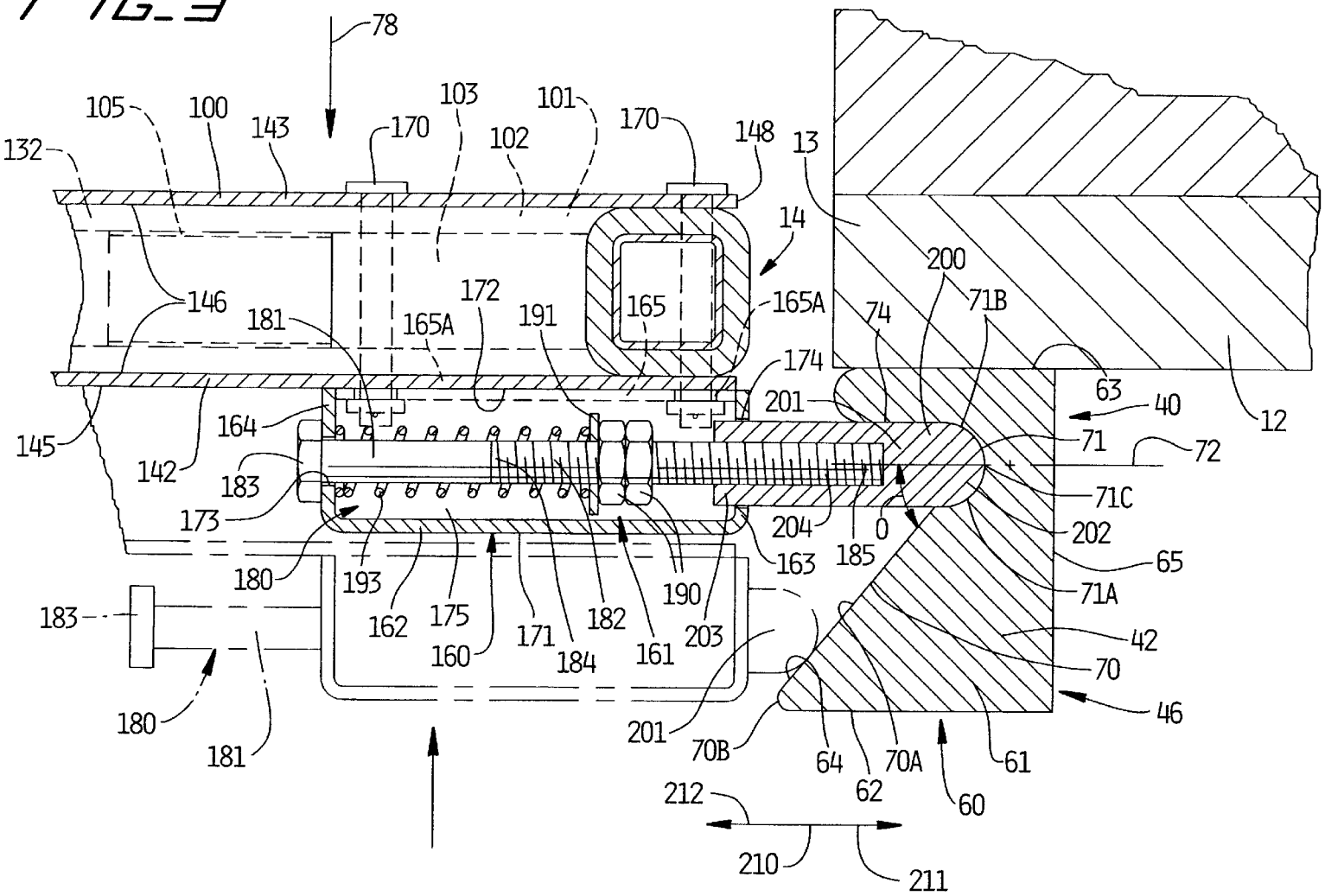
FIG. 3 is a substantially longitudinal, vertical, sectional view of a first form of the overhead door of the present invention and is taken from a position along line 3—3 of FIG. 2.

A track 60 is shown in FIG. 3. The track 60 facilitates release of the overhead door 10 when force of a predetermined magnitude is applied in only one direction. The track 60 has a longitudinal axis 60A and an elongated or main body 61. The body 61 includes both forwardly and rearwardly facing surfaces 62 and 63, and inwardly and outwardly laterally disposed surfaces 64 and 65, respectively. As best seen in FIG. 1, the rearwardly facing surface is attached to the underlying support bracket 51 by means of a suitable fastening technique such as adhesives, threaded fasteners, and other means known in the art (not shown). Further, if the track is manufactured from a synthetic, polymeric-based material, the track and underlying support bracket may be extruded as an integral assembly. The inwardly facing surface 64 defines an engagement surface 70 having an angled disengagement portion 70A which continues smoothly to a disengagement point 70B. The engagement surface 70 defines a u-shaped channel 71 which extends substantially longitudinally relative to the main body 61. As best seen in FIG. 3, the u-shaped channel is located in close proximity to the rearwardly facing surface, and the engagement surface slopes inwardly from the forwardly facing surface towards the unshaped channel, thereby defining an inclined surface.

The u-shaped channel 71 has a first side or leg 71A, a second side or leg 71B, and a curved or center portion 71C that connects the two legs. The u-shaped channel 71 also has a center axis 72 that is perpendicular to the longitudinal axis 60A of the track 60. The angled disengagement portion 70A is adjacent to and continuous with the first side or leg 71A and aligned at an acute angle θ with respect to the center axis 72 of the u-shaped channel 71.

Adjacent to and continuous with the second side or leg 71B is a projection 74 that is positioned substantially parallel to the center axis of the u-shaped channel 71. The projection 74 prevents the plunger (discussed below) from leaving the u-shaped channel 71 when the door is impacted by a force acting in the direction of arrow 79.

The track 60 is operable to release when force is applied in the direction indicated by the arrow labeled 78. However, this same track can render the overhead door 10 operable to release in the opposite direction by merely installing the respective tracks in reversed, end-to-end orientation. By placing the forwardly facing surface 62 against the wall 12, the overhead door will be operable to release when force is applied in the direction indicated by the arrow labeled 79. Thus, the present design permits the installer to select the direction of release without requiring additional parts. Further, the individual tracks 40 may have mixed sections, that is, sections that provide for release when struck in one direction, and further will release in the opposite direction when the overhead door 10 is oriented at a different height above the floor 15. For example, a factory may wish that the overhead door 10 release only when struck from the inside of the building 11 when the overhead door is in a fully down position, thus providing security from night-time break-in. However, the overhead door may be operable to release when struck from the outside of the building when the overhead door 10 is oriented at a predetermined distance above the floor 15. Additionally, if the overhead door is installed in a fashion where the door, when open, is positioned in substantially parallel relation to the floor 15, the tracks would be oriented such that the weight of the overhead door would not cause the overhead door to release from the respective tracks.

Figure 5:
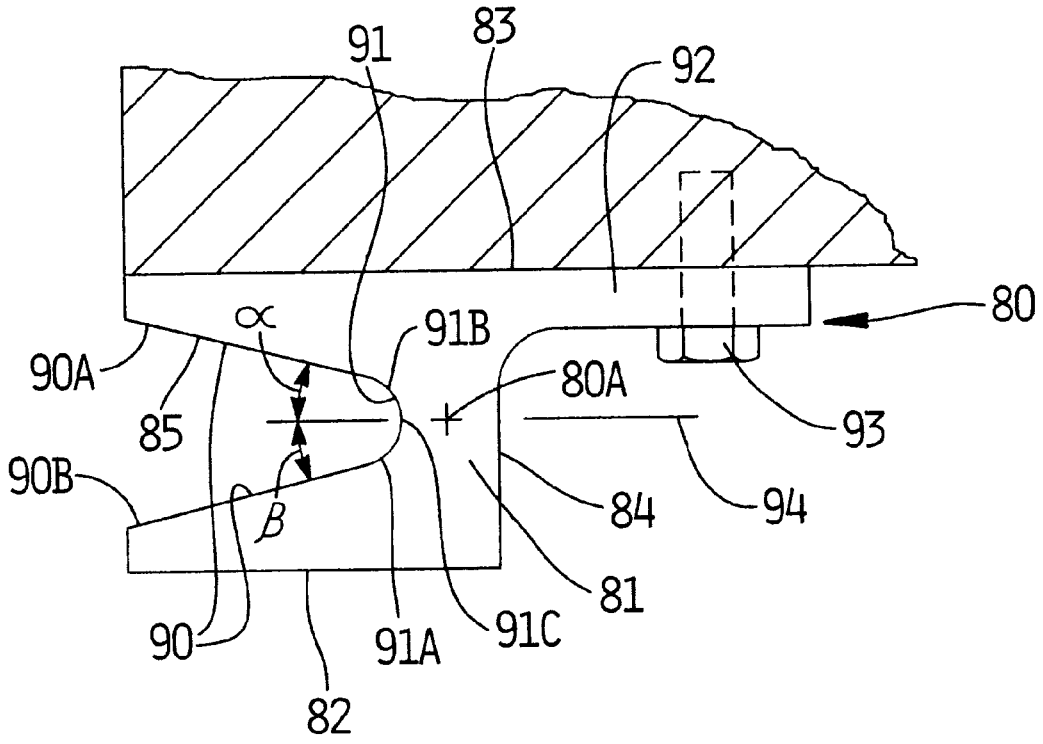
FIG. 5 is a fragmentary, vertical, sectional view of a second form of the overhead door of the present invention and shows an alternate design for the associated track.

A track 80 is shown in FIG. 5. The track 80 facilitates release of the overhead door 10 when force of a predetermined magnitude is applied in opposite directions. The track 80 has a longitudinal axis 80A and a main or elongated body 81. The main body 81 has forwardly and rearwardly facing surfaces 82 and 83, and outwardly and inwardly facing, laterally oriented surfaces 84 and 85. The inwardly facing surfaces define a pair of engagement surfaces 90 which slope inwardly from the forwardly and rearwardly facing surfaces, and provide a pair of angled disengagement portions 90A and 90B which cooperate with the release assembly, discussed in greater detail hereinafter. The engagement surfaces define a substantially unshaped channel 91 which is disposed in a substantially intermediate position between the forwardly and rearwardly facing surfaces 82 and 83, respectively, and which extends longitudinally relative to the main body. Additionally, the main body 81 has a flange portion 92 which extends substantially normally outwardly therefrom and provides a means whereby a fastener 93 may engage same and thereby secure it on the underlying wall or bulkhead 12.

The u-shaped channel 91 has a first side or leg 91A, a second side or leg 91B, and a curved or center portion 91C which connects the two legs. The u-shaped channel 91 has a center axis 92 that is perpendicular to the longitudinal axis 80A of the track 80. The angled disengagement portion 90A is adjacent to and continuous with the first side or leg 91A and aligned at an acute angle α with respect to the center axis 92. Similarly, the angled disengagement portion 90B is adjacent to and continuous with the second side or leg 91B and aligned at an acute angle β with respect to the center axis 92. Preferably, the angles α and β are equal to one another.

Figure 4:
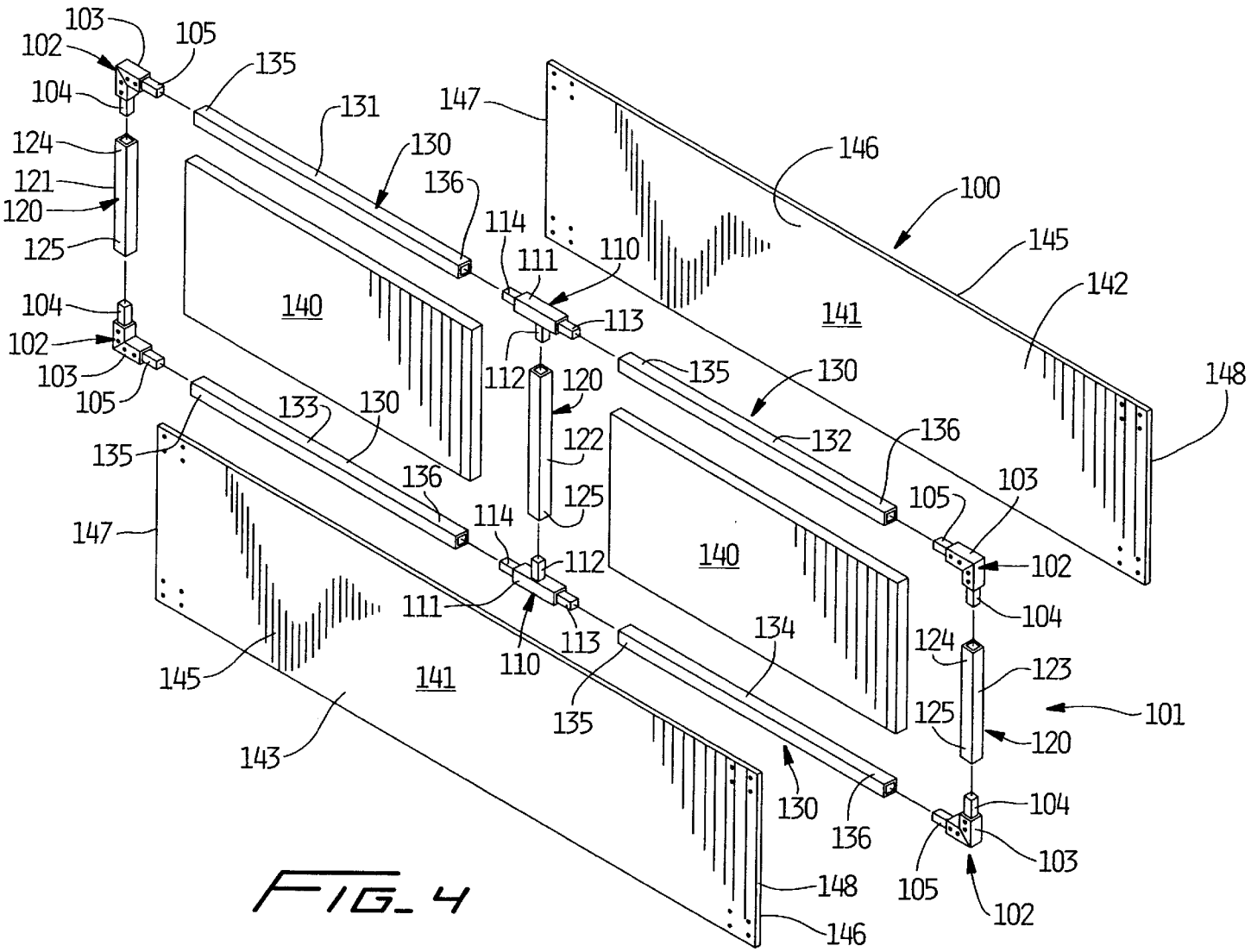
FIG. 4 is a perspective, fragmentary, exploded view of a door panel that is utilized with the overhead door of the present invention.

As best seen by reference to FIG. 4, the overhead door 10 of the present invention includes a plurality of door panels 100 which are disposed in a location intermediate the pair of tracks 40. The individual door panels are substantially identical, and therefore, for purposes of brevity, only one panel is discussed herein.

The individual door panels 100 each have a frame 101. The frame 101 includes four corner portions which are each designated by the numeral 102. The individual corner portions each have a main body 103 which has a first leg 104 and a second leg 105. The legs are oriented in substantially normal relation one to the other. The legs have cross-sectional dimensions which are less than the cross-sectional dimension of the main body. Further, each of the legs has a cross-sectional shape which is substantially square. Positioned, or oriented between the individual corner portions are a pair of central connector portions 110. The central connector portions each have a T-shaped main body 111 which has a first leg 112, a second leg 113, and a third leg 114. The first, second, and third legs are substantially square and have a cross-sectional dimension which is less than the cross-sectional dimension of the main body 111.

Three substantially vertically oriented support members 120 are operable to interconnect or join the corner portions 102 and the central connector portions 110, respectively, together. The three substantially vertically oriented support members are designated by the numerals 121, 122, and 123, respectively. The individual support members, which are substantially identical in their length dimension, have a first end 124 and an opposite, second end 125. Further, the individual members 121, 122, and 123, respectively, have internal cross-sectional dimensions which are just slightly greater than the outside cross-sectional dimensions of the individual legs 104.

Each of the first legs 104 and 112, respectively, telescope internally of the respective support members 121, 122, and 123, thereby providing vertical supports for the individual door panels 100. The frame 101 further has four horizontally oriented support members which are designated generally by the numeral 130. The horizontal support members are further individually designated by the numerals 131, 132, 133, and 134, respectively. These individual horizontal support members also have a first end 135 and an opposite, second end 136. Each of the horizontal support members have an inside cross-sectional dimension which is greater than the outside cross-sectional dimensions of the individual second legs 105, 113, and 114, respectively. This, of course, permits the respective second legs to telescopingly engage the individual horizontal members thereby providing a narrowly rectangular and rigid frame 101.

The frame 101 can be manufactured from a number of different materials both natural and man-made. However, it is advantageous if the frame of the door panel is fabricated from a lightweight, yet high strength material such as fiberglass or an extruded polymeric-based material. Further, various fastening means may be utilized to secure the individual parts of the frame 101 together. These fastening means may include all manner of screw-type fasteners as well as adhesives, welding, or the like.

Two insulating/sound proofing sheets 140 are sandwiched between the horizontal and vertical frame members 120 and 130. The sheets provide improved performance characteristics for the individual door panels 100. The insulation sheets 140 have length, width, and height dimensions which are substantially identical to the dimensional characteristics of the area which is defined between the individual frame members 120 and 130. Two exterior facing cover panels 141 are provided. The cover panels 141 include a front, or first panel 142, and a second or rear panel 143. As best seen by reference to FIG. 1, three hinges 144, are provided and operate to join the individual door panels 100 together, thereby providing an overhead door 10 which has an articulated design. The individual cover panels 141 may be manufactured from natural or synthetic materials, however, a high-strength, lightweight material is preferred. The individual cover panels further have an exterior surface 145 and an interior surface 146. Additionally, the exterior surface has a left lateral edge 147 and a right lateral edge 148.

Figure 2:
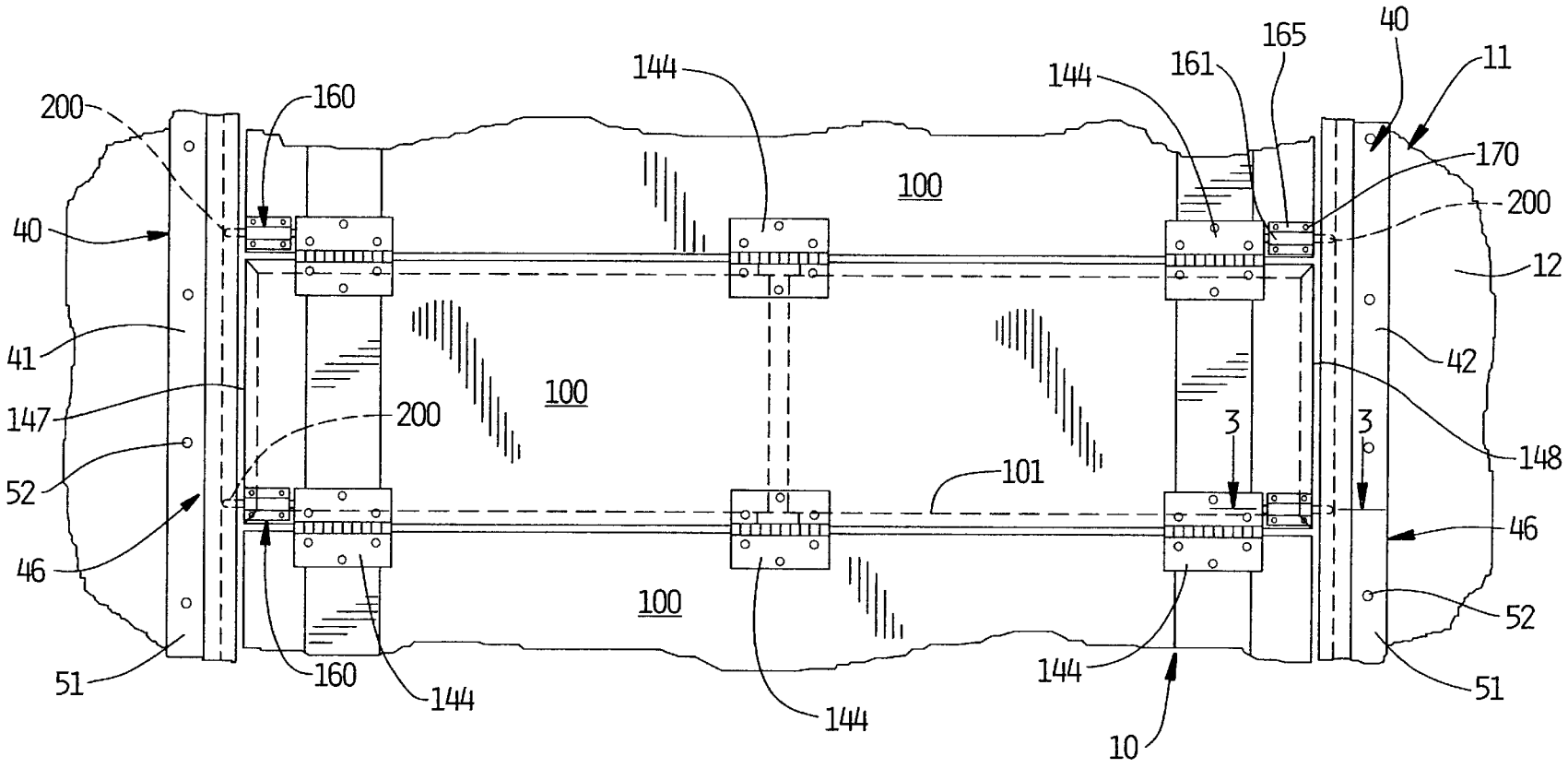
FIG. 2 is a fragmentary, side elevational view of the overhead door of the present invention and is taken from a position along line 2—2 of FIG. 1.

As best seen by reference to FIGS. 1 and 3, the overhead door 10 is operable to be released, upon exposure to force of a predetermined magnitude from the tracks 40 by means of a release assembly 160. As best seen by reference to FIG. 2, two release assemblies are individually mounted in close proximity to the left and right lateral edges 147 and 148, respectively. While a pair of release assemblies is shown in the drawings, it will be recognized that four release assemblies may be used in some applications due, in part, to the size of the door panel employed. The individual release assemblies include a housing 161 which is defined by a side wall 162. The housing further includes a front wall 163 and a rear wall 164. The walls are disposed in predetermined substantially parallel, spaced relation one to the other. A flange 165 is made integral with the housing 161 and includes a plurality of apertures 165A which are positioned in a predetermined pattern and accommodate individual fasteners 170 which are operable to matingly engage the underlying door panels 100. The fasteners may be manufactured from a frangible material which will shatter or otherwise break when exposed to a shearing force of a predetermined magnitude. These fasteners provide additional safety against damage to the overhead door assembly 10 when force is applied to it.

The side wall and front and rear walls each have an exterior facing surface 171 and an opposite, interior facing surface 172. An aperture 173 of predetermined dimensions is formed in the rear wall and a front aperture 174 is defined by the front wall. The apertures 173 and 174 are substantially coaxially aligned. As best appreciated by a study of FIG. 3, the rear aperture has a predetermined diametral dimension, and the front aperture has a diametral or cross-sectional dimension which is greater than the rear aperture. The interior facing surface 172 defines a cavity 175 which encloses the internal mechanism of the release assembly, discussed below.

The housing 161 encloses a plunger assembly 180. The plunger assembly has a main body 181 which has a threaded shaft portion 182 and a head 183 mounted on the distal end thereof. The threaded shaft portion has a first end 184, and an opposite, second end 185. As best seen in FIG. 3, the main body of the plunger assembly is sideably received in the coaxially aligned apertures 173 and 174, respectively. Two nuts 190 threadably engage the threaded shaft portion and are located in a predetermined location along the threaded shaft. A washer 191 is received about the threaded shaft and is positioned between the head 183 and the pair of nuts 190. A biasing spring 193 is biased between the rear wall 164 and the washer 191. The spring 193 is operable to urge the head 183 in the direction of the rear wall.

The individual nuts, which act as a stop member for the spring, may be threaded toward the head in order to compress the biasing spring, thereby causing increased force to be applied to the threaded shaft. Thus, the amount of force which is necessary to dislodge the overhead door 10 from the pair of tracks 40 may be adjusted.

A plunger 200 is releasably fixed on the threaded shaft portion 182 of the main body 181. The plunger has a main body 201 which has a first end 202 which engages the respective tracks 40. A second end 203 of the plunger has a threaded channel 204 formed therein which is operable to threadably mate with the threaded shaft portion 182. The plunger assembly is reciprocally moveable along a predetermined path of travel 210 from a first, engaged, or extended position 211 (FIG. 3), where it is operable to be received in the u-shaped channel 71 of the individual tracks 40, to a second, depressed, or releasing position 212.

In the second position, the plunger assembly is urged backwardly against the force of the biasing spring 193. When located in the second position, the plunger may be urged upwardly along the engagement surface 72 following the application of force of a predetermined magnitude to the door panel 100. When force is applied to the overhead door 10, the plunger assembly is forced rearwardly until the door panel 100 is released from the track 40 thereby avoiding damage to the overhead door 10, the track 40, or any surrounding or structure. To reset the overhead door in the respective tracks 40, an individual would grasp the head 183 of the main body 181 and pull it rearwardly, thereby permitting the plunger 200 to be moved into engagement with the u-shaped channel 71. Biasing springs of different strengths can be selected to provide overhead doors which release at desired levels of force.

OPERATION

The overhead door 10 includes a pair of tracks 40 mounted on a structure such as a wall or bulkhead 12. Each of the tracks has an inwardly facing surface 65 which defines a channel 71. An individual door panel 100 is located intermediate the pair of tracks and is moveable along a predetermined path of travel 40A which is defined by the pair of tracks. A release assembly 160 is borne by the door panel and is operable to releasably engage at least one of the tracks. The release assembly includes a plunger 200 which is received in the channel of one of the tracks and which guides the door panel along the path of travel. The door panel becomes disengaged from the channel when force of a predetermined magnitude and direction is applied to the door panel. Force of a predetermined magnitude applied in a specific direction may, or may not, cause the release of the overhead door 10 from the associated track. For example, if track 60 is used, the force of a predetermined magnitude must be applied in a specific direction in order to cause the door panel to move to a disengaged orientation relative to the track 40. On the other hand, track 80 is operable to release when force is applied in either direction to the overhead door. Tracks which are employed with a specific overhead door may include tracks which have either one profile or the other or a combination of both. This would provide an overhead door that would release in predetermined directions if struck at predetermined distances above the surface of the floor 15.

Although the invention has been herein shown and described in what is conceived to be the most practical and preferred embodiments, it is recognized that departures may be made therefrom within the scope of the invention which is not to be limited to the illustrative details disclosed.

We claim:

1. A door releasable from its operative position upon an impact force in a release direction to prevent damage to the door, the door comprising:

(a) a pair of mutually opposed, elongate tracks mountable on a structure defining a door opening, at least one of the tracks having an inwardly facing channel member, said channel member having:
  (1) a guide segment for guiding the movement of the door in a movement plane defined by the pair of opposed channels, said guide segment having a wall surface with a predetermined profile; and
  (2) a release segment communicating with said guide segment, said release segment having an oblique wall surface extending in the release direction to a distal release point;

(b) a substantially rigid door panel for being positioned in the door opening defined between the pair of tracks and moved along a path of travel which is defined by the pair of tracks; and (c) a release assembly carried by the door panel and operable to releasably engage the door panel from at least one of the tracks, the release assembly including;
  (1) a plunger carried by the door panel and having an outwardly-extending distal end having a shape for being received in the guide segment of the channel of a respective one of the tracks for guiding the door panel along its predetermined path of travel during normal operation, and being displaceable from the guide segment of the channel and along the oblique wall surface of the release segment of the channel to the release point upon occurrence of impact to the door in the release direction; and
  (2) biasing means carried by the door panel for biasing the plunger in the guide segment of the channel and for permitting controlled movement of the plunger from the guide segment of the channel along the oblique wall surface of the release segment of the channel to the release point.

2. A door according to claim 1, wherein the profile of the guide segment of the channel and the shape of the distal end of the plunger are complementary.

3. A door according to claim 2, wherein the profile of the guide segment of the channel is arcuate in cross-section and the shape of the distal end of the plunger is hemispherical with an arcuate cross-section.

4. A door according to claim 2 or 3, wherein said biasing means comprises a spring positioned in a housing carried by the door.

5. A door according to claim 4, wherein the plunger includes a shaft having a stop member, the spring being received coaxially on the shaft and positioned between the stop member and the housing.

6. A door according to claim 5, each of said pair of tracks including an inwardly facing channel member having:

(a) a guide segment for guiding the movement of the door in a movement plane defined by the pair of opposed channels, said guide segment having a wall surface with a predetermined profile; and (b) a release segment communicating with said guide segment, said release segment having an oblique wall surface extending in the release direction.

* * * * *